US005934202A

United States Patent [19]

Lai

[11] Patent Number: 5,934,202

[45] Date of Patent: Aug. 10, 1999

[54] STRUCTURE OF PAPER PALLET

[76] Inventor: Chein Tsai Lai, No. 9, Nan-Ho Countryside, Shui-Shang Hsiang, Chiia I, Taiwan

[21] Appl. No.: 09/136,917

[22] Filed: Aug. 20, 1998

[51] Int. Cl.[6] ..... B65D 19/00

[52] U.S. Cl. ..... 108/51.3; 108/57.33

[58] Field of Search ..... 108/51.11, 51.3, 108/57.1, 57.2, 57.33

[56] References Cited

U.S. PATENT DOCUMENTS

| | | | |
|---|---|---|---|
| 2,928,638 | 3/1960 | Parker | 108/51.3 |
| 5,213,050 | 5/1993 | Juvik-Woods | 108/51.3 |
| 5,385,103 | 1/1995 | Juvik-Woods | 108/56.3 |
| 5,832,841 | 11/1998 | Crews et al. | 108/56.3 |

*Primary Examiner*—Peter M. Cuomo
*Assistant Examiner*—Jerry A. Anderson
*Attorney, Agent, or Firm*—Rosenberg, Klein & Bilker

[57] ABSTRACT

A paper pallet includes a bottom deckboard made of a corrugated paper board, a top deckboard made of a corrugated paper board, a plurality of paper blocks longitudinally and transversely arranged in rows and connected between the bottom deckboard and the top deckboard, and a plurality of paper packing members respectively adhered between the paper blocks and one of the bottom deckboard and the top deckboard, the packing members each having an elongated base adhered between one of the bottom deckboard and the top deck board and one row of the paper blocks and pairs of packing flaps bilaterally extended from two opposite long sides of the elongated base and respectively adhered to the corresponding row of blocks at two opposite sides.

8 Claims, 11 Drawing Sheets

STRUCTURE OF PAPER PALLET

BACKGROUND OF THE INVENTION

The present invention relates to pallets, and more particularly to a paper pallet which comprises packing members respectively packed on blocks thereof at two opposite sides to reinforce the structural strength.

FIG. 1 shows a paper pallet according to the prior art. This structure of paper pallet comprises a bottom deckboard 10*a*, a top deckboard 12*a*, and a plurality of cylindrical blocks 11*a* connected between the bottom deckboard 10*a* and the top deckboard 12*a* and defining a plurality of entries 13*a* for the forks of a forklift truck. Because the bottom deckboard 10*a* and the top deckboard 12*a* are respectively fastened to the top and bottom sides of the cylindrical blocks 11*a* by adhesion, the binding power between the deckboards 10*a*, 12*a* and the blocks 11*a* is weak, and the blocks 11*a* tend to be forced out of place or destroyed. Therefore, the service life of this structure of paper pallet is short.

SUMMARY OF THE INVENTION

It is one object of the present invention to provide a paper pallet which is reinforced with packing means. It is another object of the present invention to provide a paper pallet which is inexpensive to manufacture. It is still another object of the present invention to provide a paper pallet which is reclaimable. According to one aspect of the present invention, the paper pallet comprises a bottom deckboard made of corrugated paper board, a top deckboard made of corrugated paper board, a plurality of paper blocks longitudinally and transversely arranged in rows and connected between the bottom deckboard and the top deckboard, and a plurality of paper packing members respectively adhered between the paper blocks and one of the bottom deckboard and the top deckboard, the packing members each having an elongated base adhered between one of the bottom deckboard and the top deck board and one row of the paper blocks and pairs of packing flaps bilaterally extended from two opposite long sides of the elongated base and respectively adhered to the corresponding row of blocks at two opposite sides. According to another aspect of the present invention, the packing members include bottom packing members adhered between the bottom deckboard and the paper blocks and packed on the paper blocks, and top packing members adhered between the top deckboard and the paper blocks and packed on the paper blocks. According to still another aspect of the present invention, the top packing members and the bottom packing members can be arranged in parallel, or alternatively in crossed directions.

DETAILED DESCRIPTION OF THE PREFERRED EMBODIMENT

Figure 1:
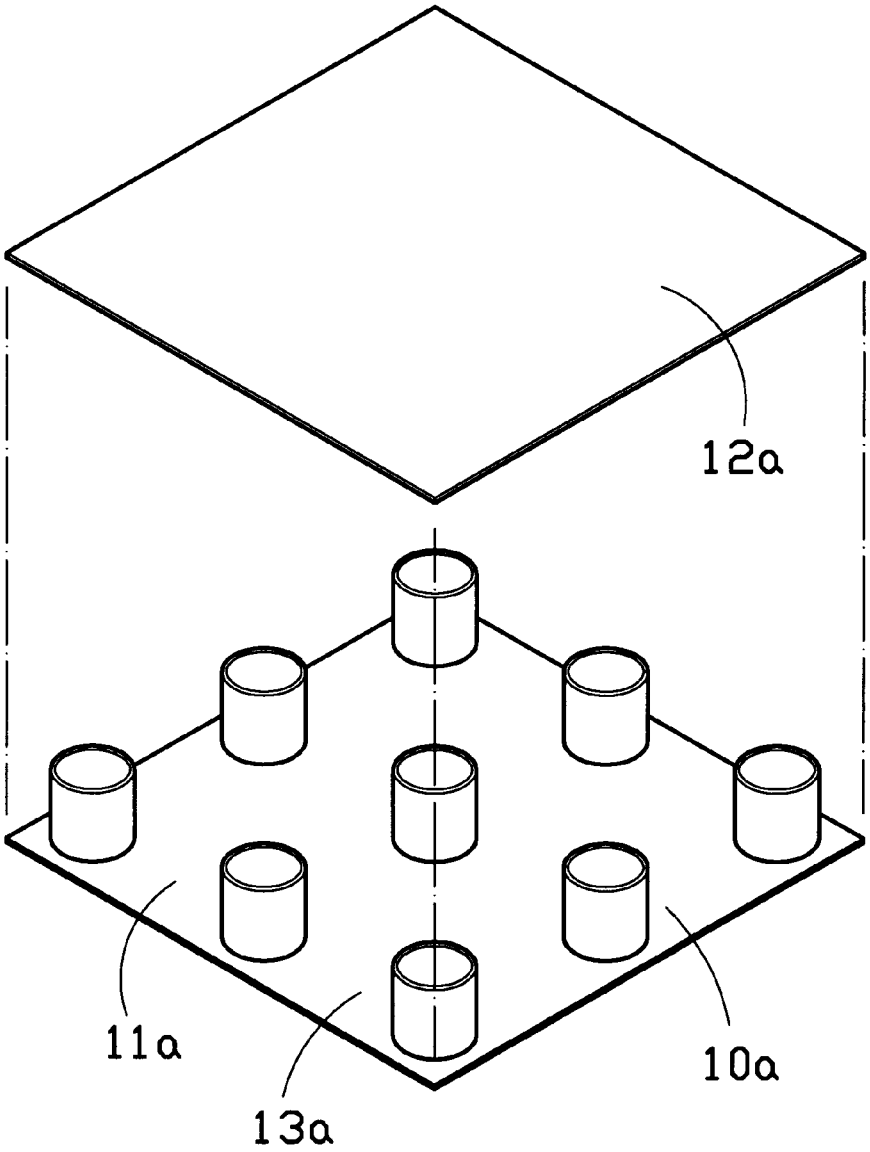
FIG. 1 PRIOR ART
FIG. 1 is an exploded view of a paper pallet according to the prior art.
Figure 2:
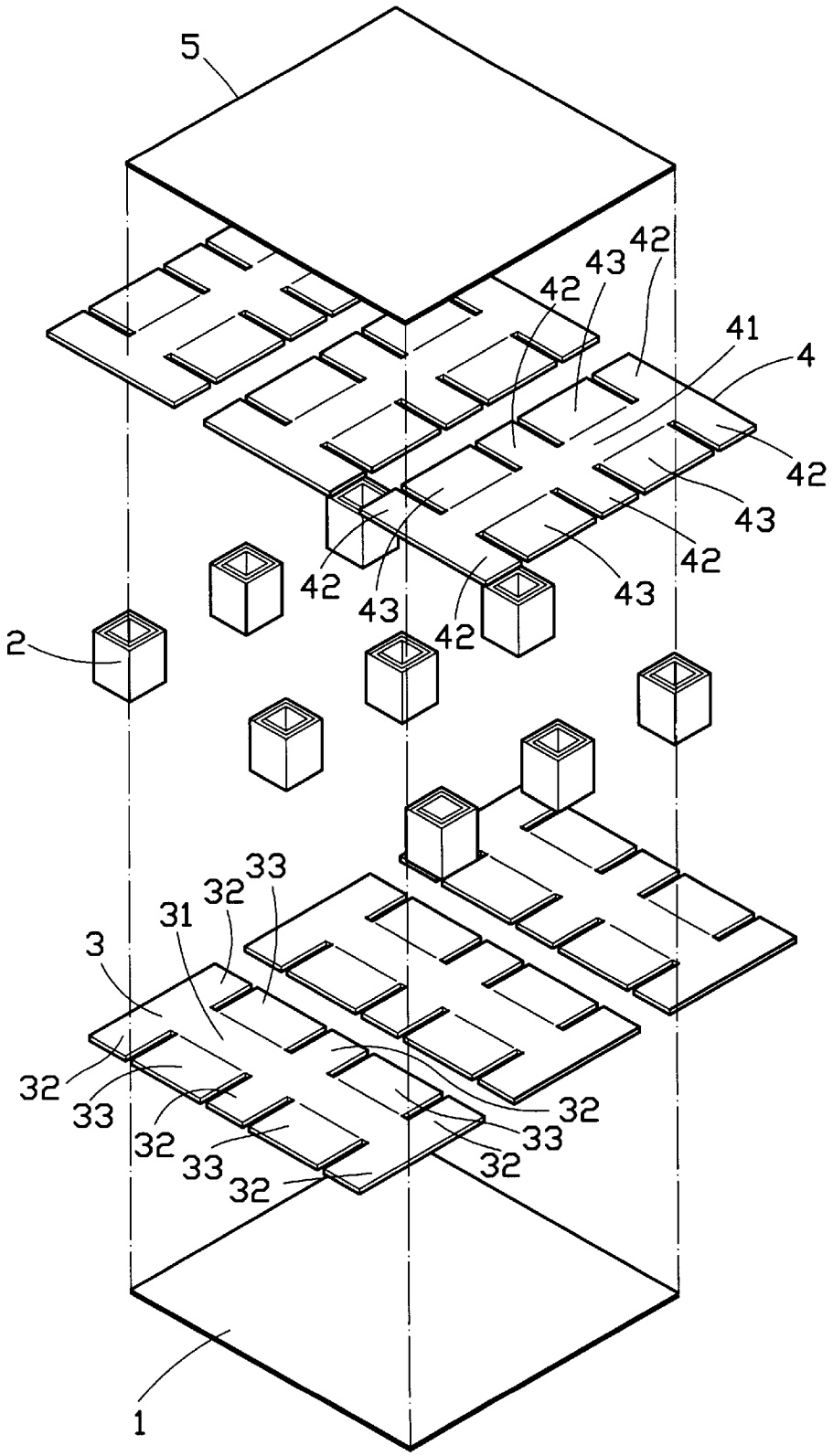
FIG. 2 is an exploded view of a paper pallet according to one embodiment of the present invention.

Referring to Fugue 2, a pallet in accordance with the present invention is generally comprised of a bottom deckboard 1, a plurality of blocks 2, a plurality of bottom packing members 3, a plurality of upper packing members 4, and a top deckboard 5.

The bottom deckboard 1 is made of rectangular cardboard or corrugated paper board. The bottom side wall of the bottom deckboard 1 is preferably covered with a layer of PE (polyethylene) film, or coated with a layer of water proof coating.

Figure 6:
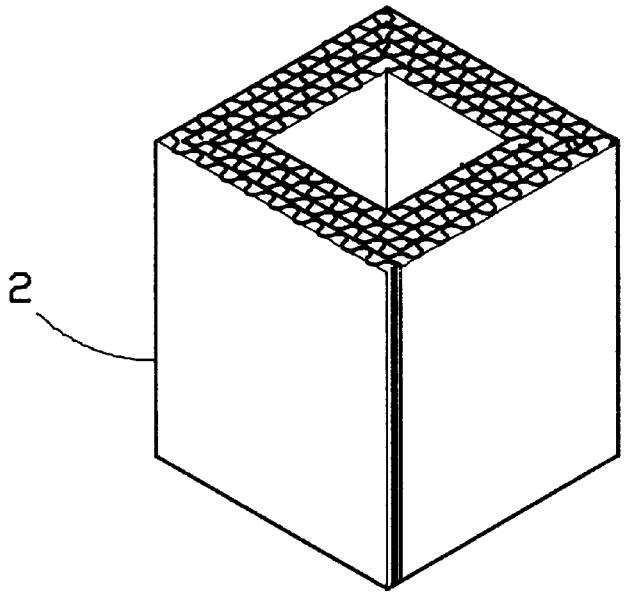
FIG. 6 is a perspective view of one block according to the present invention.
Figure 7:
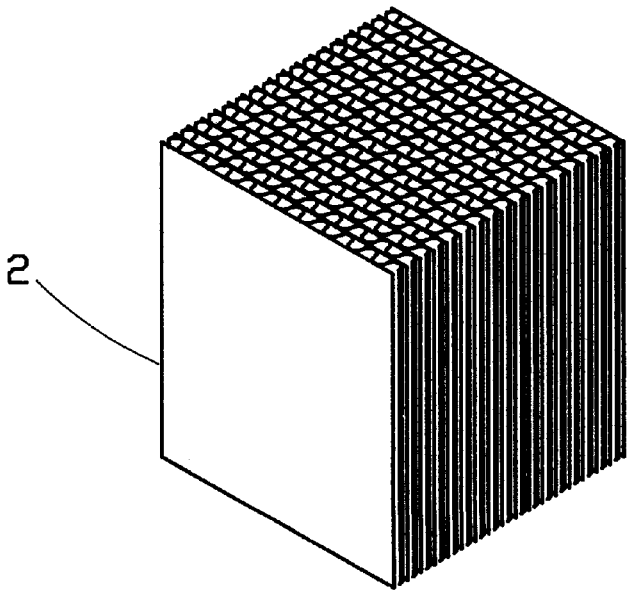
FIG. 7 is a perspective view of an alternate form of the block according to the present invention.
Figure 8:
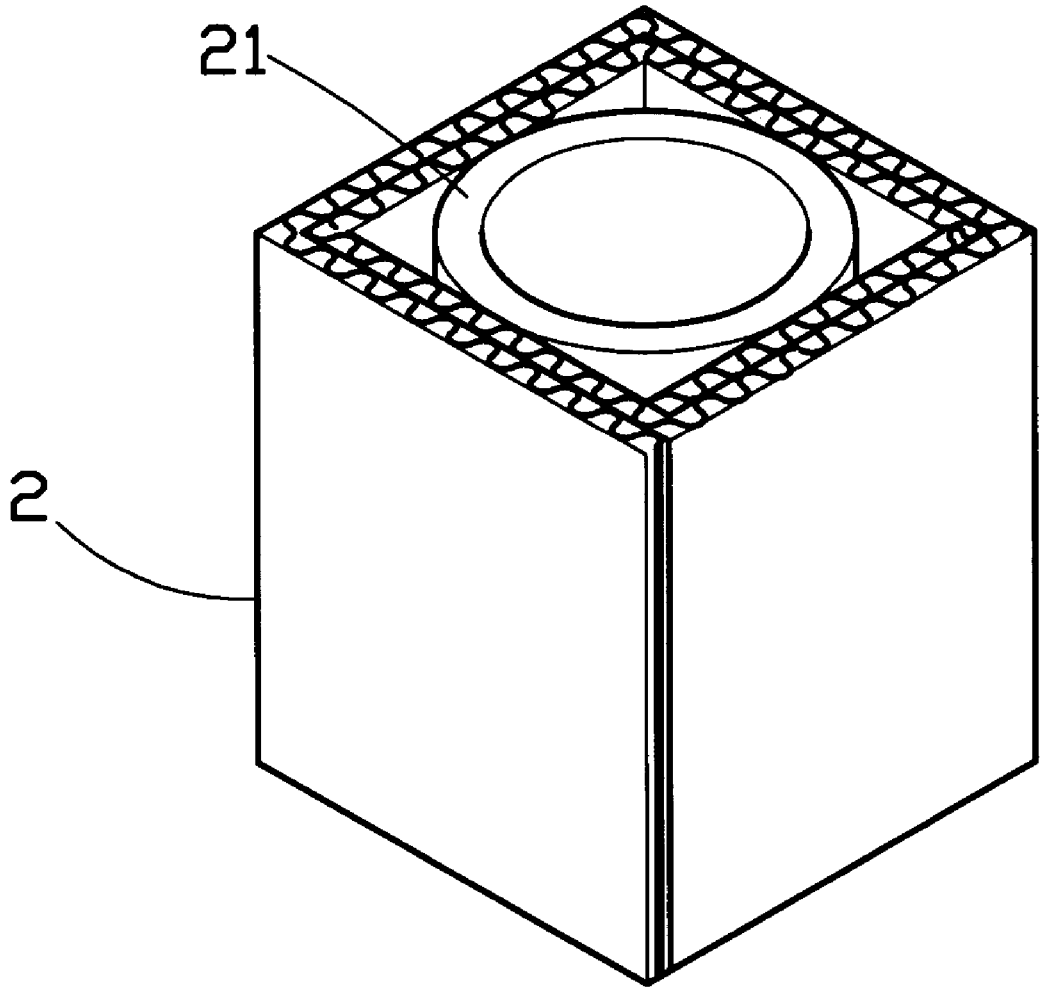
FIG. 8 is a perspective view of another alternate form of the block according to the present invention.
Figure 12:
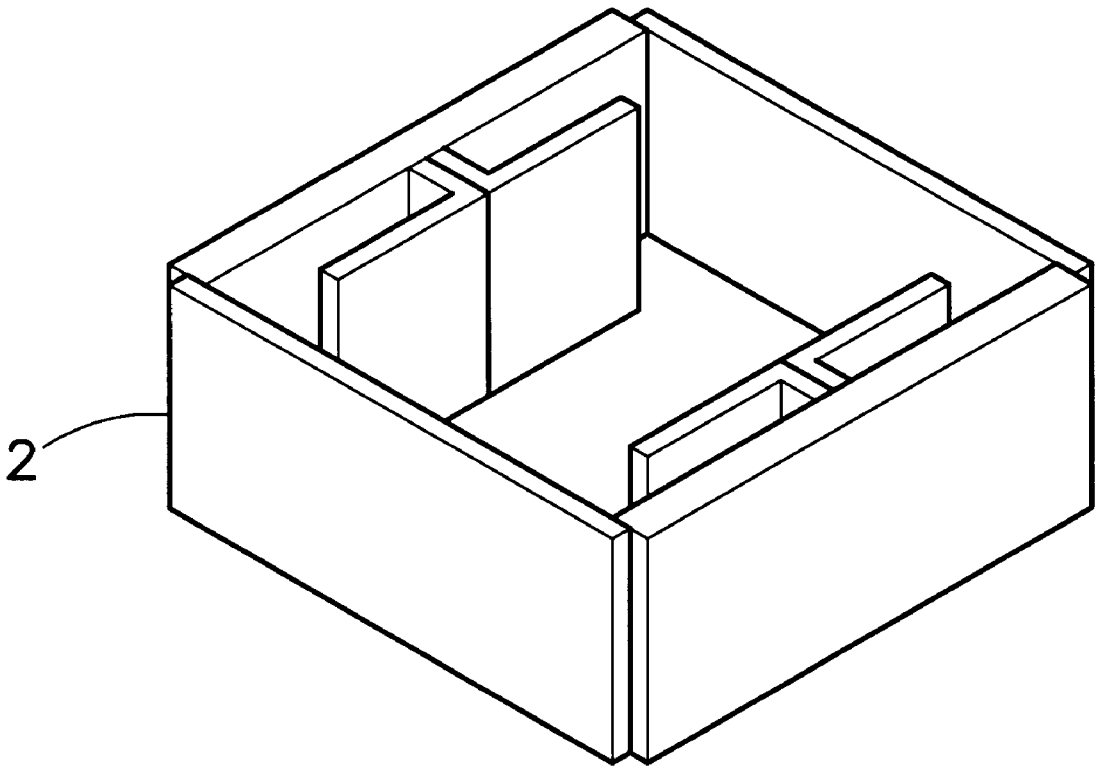
FIG. 12 is a perspective view of still another alternate form of the block according to the present invention.
Figure 13:
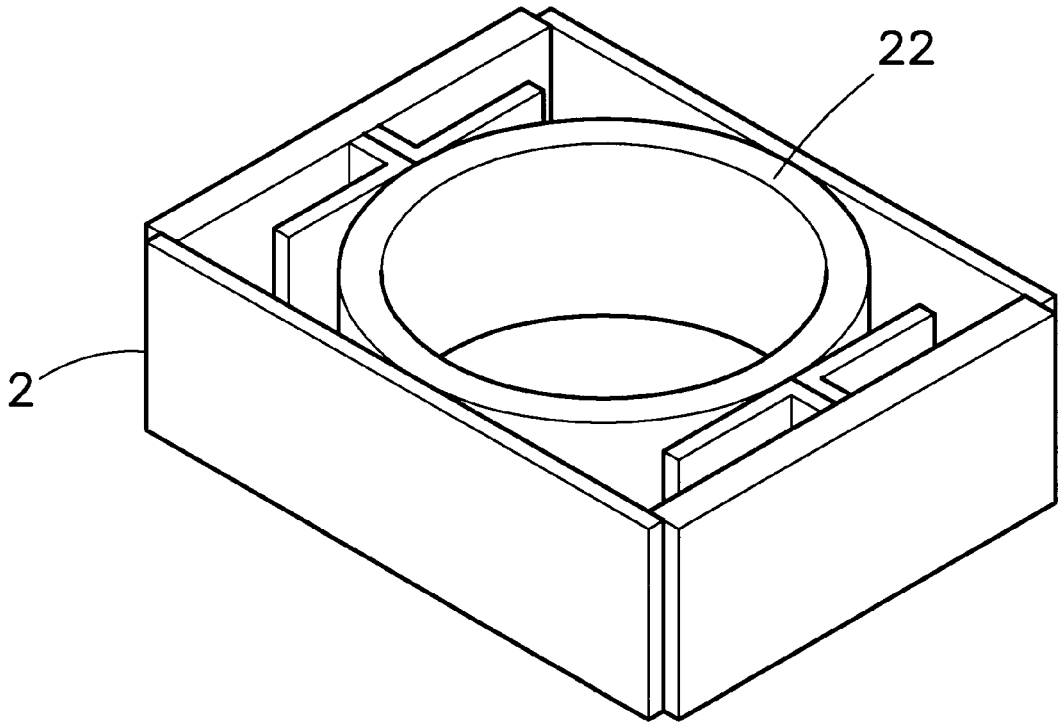
FIG. 13 is a perspective view of still another alternate form of the block according to the present invention.

The blocks 2 are made of corrugated paper board, and longitudinally transversely aligned between the bottom deckboard 1 and the top deckboard 5. The blocks 2 can be made by: bending pieces of rectangular corrugated paper boards of equal width but different lengths into hollow rectangular frames, permitting one hollow rectangular frame to be wrapped within another and then well sealed together (see FIG. 6), or arranging pieces of rectangular corrugated paper board of equal size into a stack (see FIG. 7), or mounting a cardboard tube 21 within a rectangular open frame of corrugated paper board (see FIG. 8), or folding a piece of corrugated paper board into a case-like block (see FIG. 12), or folding a piece of corrugated paper board into a case-like block and then mounting a cardboard tube 22 within the case-like block (see FIG. 13). The number of the blocks 2 can be 9 or 12 subject to the size of the pallet to be made.

The bottom packing members 3 are respectively made of corrugated paper board. Each bottom packing member 3 comprises an elongated base 31 of length equal to the longitudinal length of the bottom deckboard 1 and the top deckboard 5, pairs of packing flaps 32 bilaterally extended from the elongated base 31, and pairs of reinforcing flaps 33 bilaterally extended from the elongated base 31 and alternatively spaced by the packing flaps 32. The width of the elongated base 31 is equal to the width of the blocks 2. The length of the packing flaps 32 is equal to the height of the blocks 2. The reinforcing flaps 33 are respectively folded up and closely attached to the elongated base 31 to reinforce the structural strength of the respective bottom packing members 3.

The top packing members 4 are respectively made of corrugated paper board. Each top packing member 4 comprises an elongated base 41 of length equal to the longitudinal length of the bottom deckboard 1 and the top deckboard 5, pairs of packing flaps 42 bilaterally extended from the elongated base 41, and pairs of reinforcing flaps 43 bilaterally extended from the elongated base 41 and alternatively spaced by the packing flaps 42. The width of the elongated base 41 is equal to the width of the blocks 2. The length of the packing flaps 42 is equal to the height of the blocks 2. The reinforcing flaps 43 are respectively folded up and closely attached to the elongated base 41 to reinforce the structural strength of the respective top packing members 4.

The top deckboard 5 is made of rectangular cardboard or corrugated paper board. The size of the top deckboard 5 is equal to the bottom deckboard 1. The top side wall of the top deckboard 5 is preferably covered with a layer of PE (polyethylene) film, or coated with a layer of water proof coating.

Figure 3:
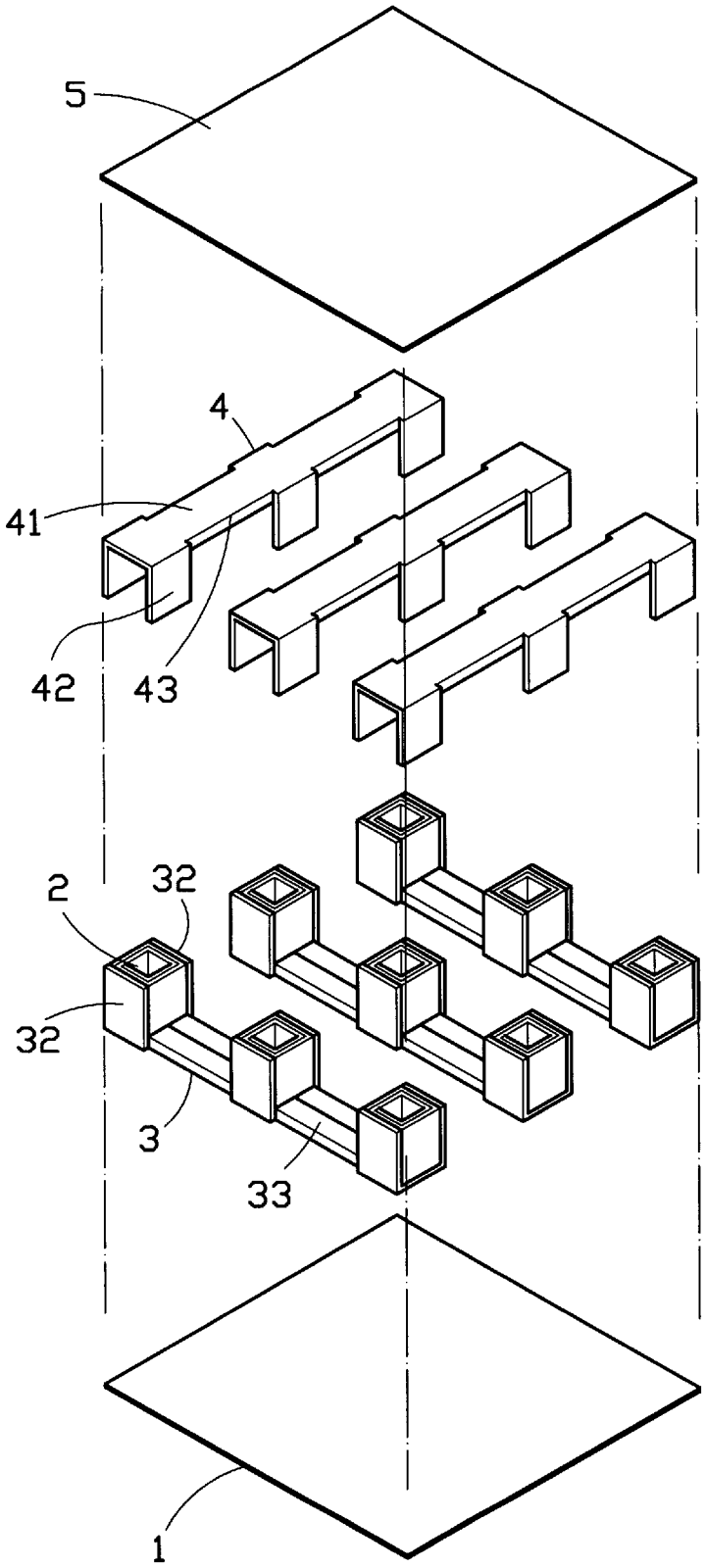
FIG. 3 is another exploded view of the present invention, showing the bottom packing members fastened to the blocks, the top packing members folded into shape.
Figure 4:
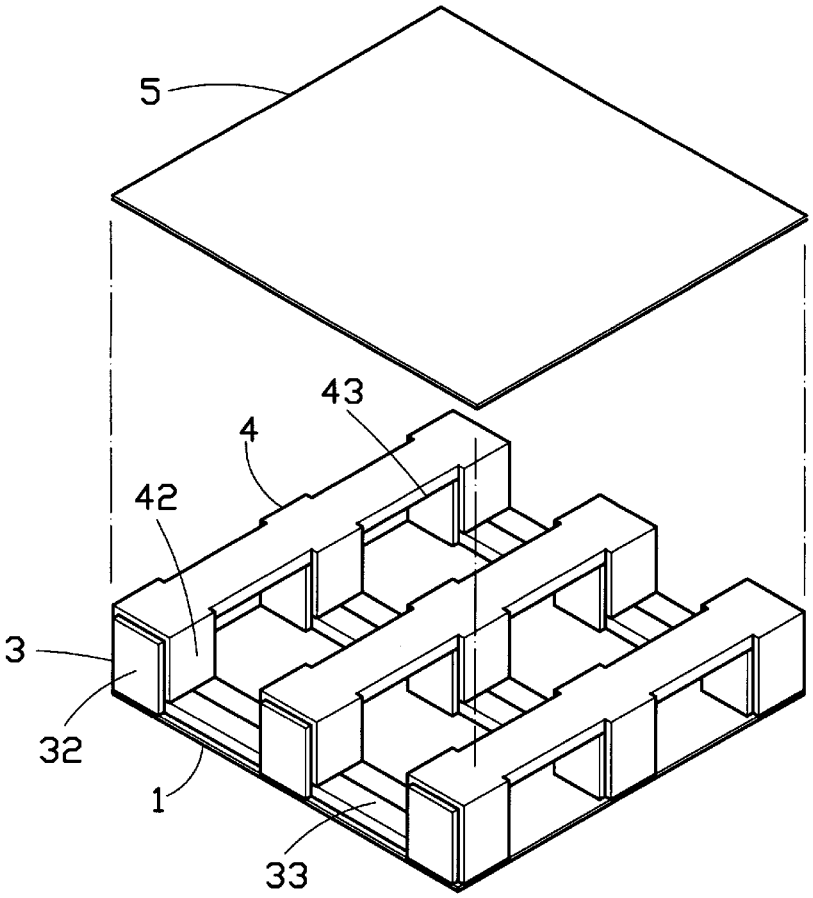
FIG. 4 illustrates the bottom packing members and the top packing members fastened to the blocks according to the present invention.
Figure 5:
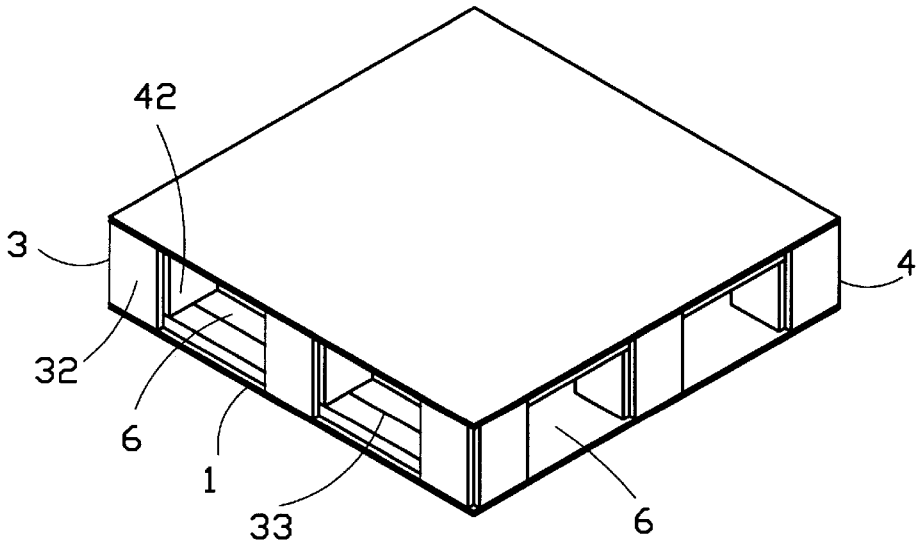
FIG. 5 is a perspective view of the present invention.

Referring to FIGS. 3, 4 and 5, the elongated bases 31,41 of the packing members 3,4 are respectively bent upwards and adhered to the bottom and top sides of the blocks 2 in longitudinal or transverse direction, then the packing flaps 32 of the bottom packing members 3 are respectively adhered to the left and right side walls of the blocks 2, and then the packing flaps 42 of the top packing members 4 are respectively bent downwards and adhered to the front and rear side walls of the blocks 2, and then the bottom deckboard 1 and the top deckboard 5 are respectively adhered to the elongated bases 31 of the bottom packing members 3 and the elongated bases 41 of the top packing members 4. When assembled, entries 6 are defined between the bottom deckboard 1 and the top deckboard 5 (between blocks 2) into which the forks of a forklift truck can be inserted.

Because packing members 3,4 are respectively packed on the blocks 2 between the deckboards 1,5, the blocks 2 are well protected, and the structure of the pallet is reinforced. Because all parts of the pallet are made of cardboard or corrugated paper boards, the manufacturing cost of the pallet is low, and the materials of the pallet can be reclaimed when the pallet is damaged. Further, the adhesive which is used to adhere parts of the pallet together is preferably obtained from natural substances that do not make any damage to the environment.

Figure 9:
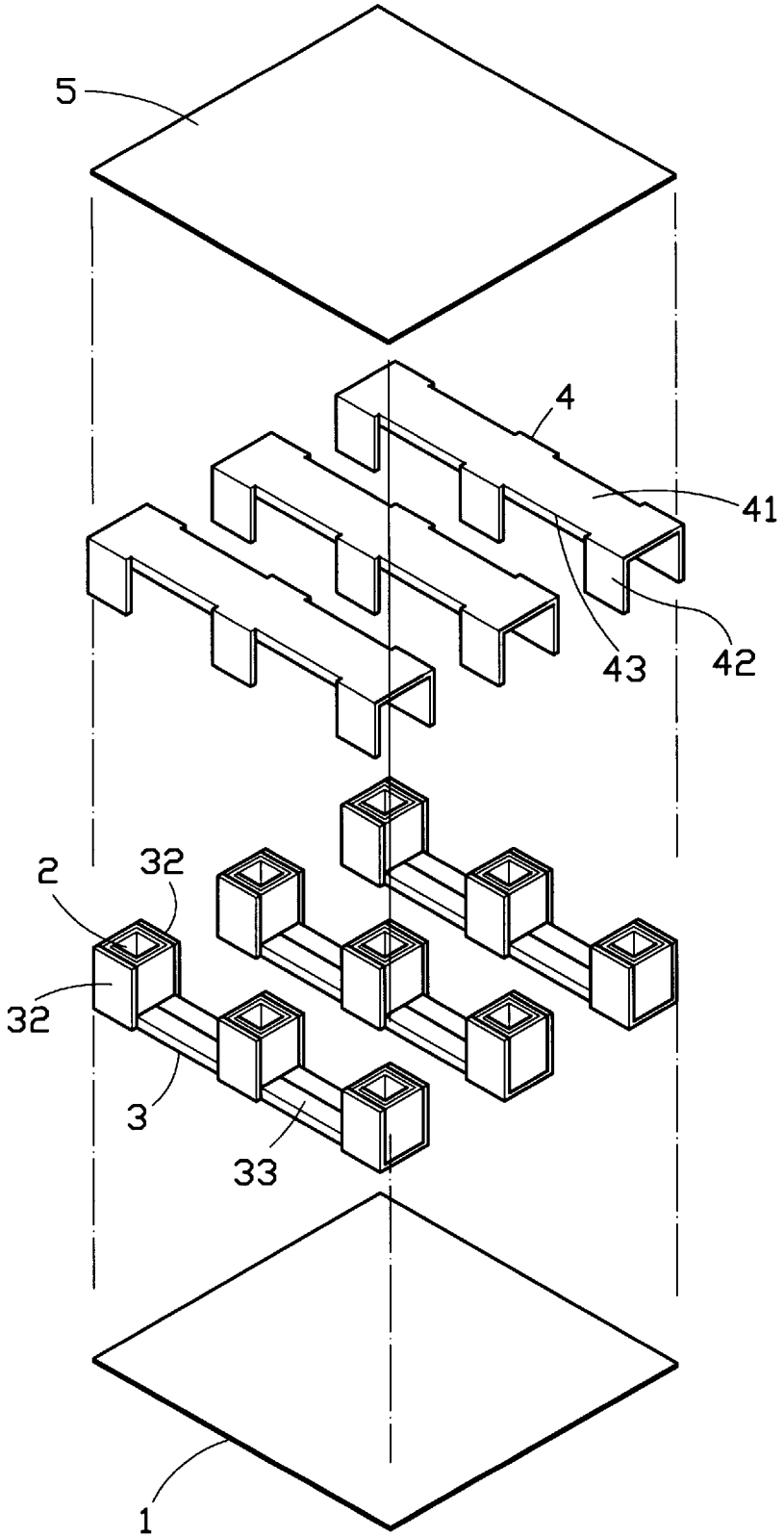
FIG. 9 is an exploded view of a pallet according to a second embodiment of the present invention.

FIG. 9 shows an alternate form of the present invention, in which the bottom packing members 3 and the top packing members 4 are respectively packed on the blocks 2 and arranged in the same direction.

Figure 10:
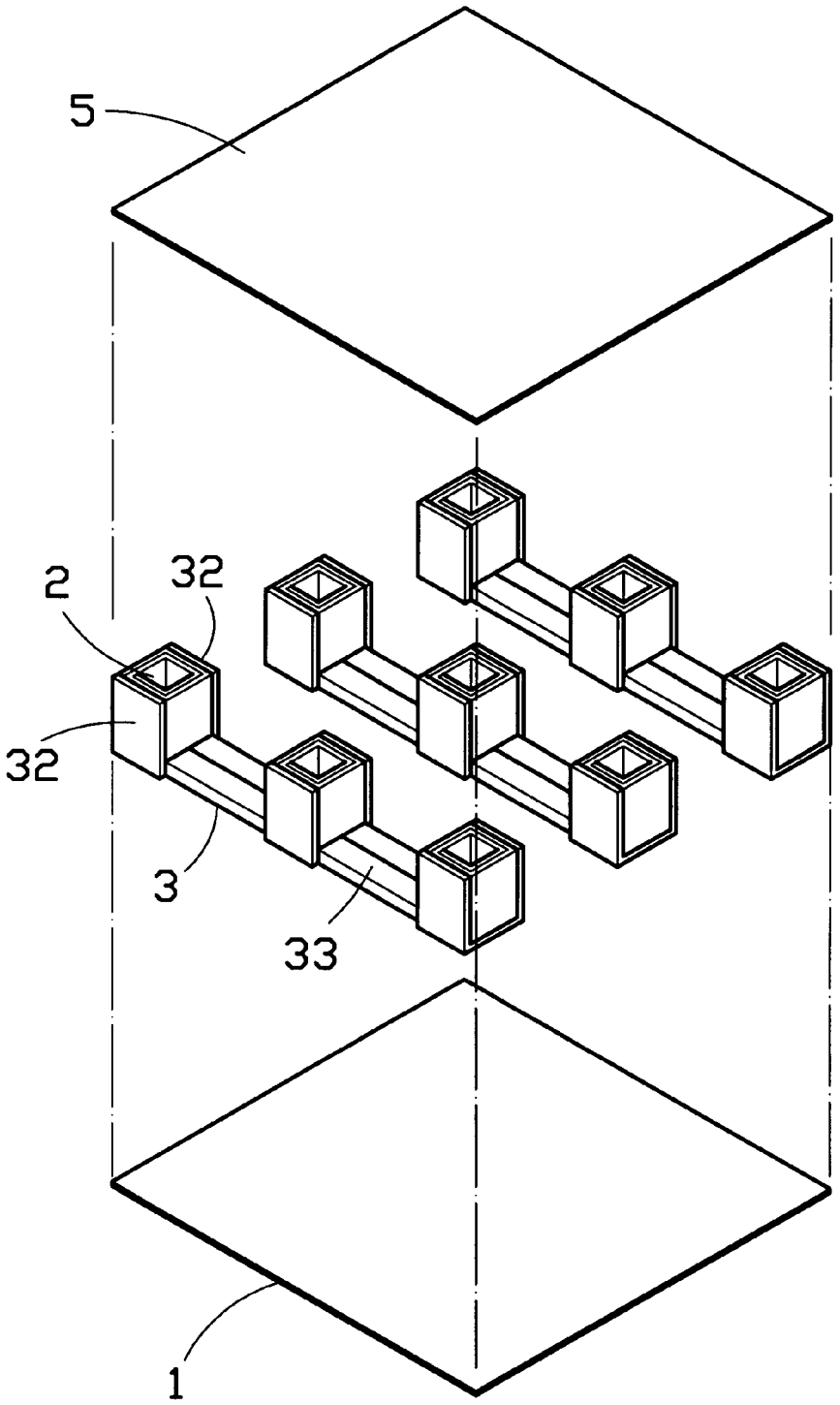
FIG. 10 is an exploded view of a pallet according to a third embodiment of the present invention.

FIG. 10 shows another alternate form of the present invention, in which the aforesaid top packing members 4 are eliminated, and only the bottom packing members 3 are used packed on the blocks 2.

Figure 11:
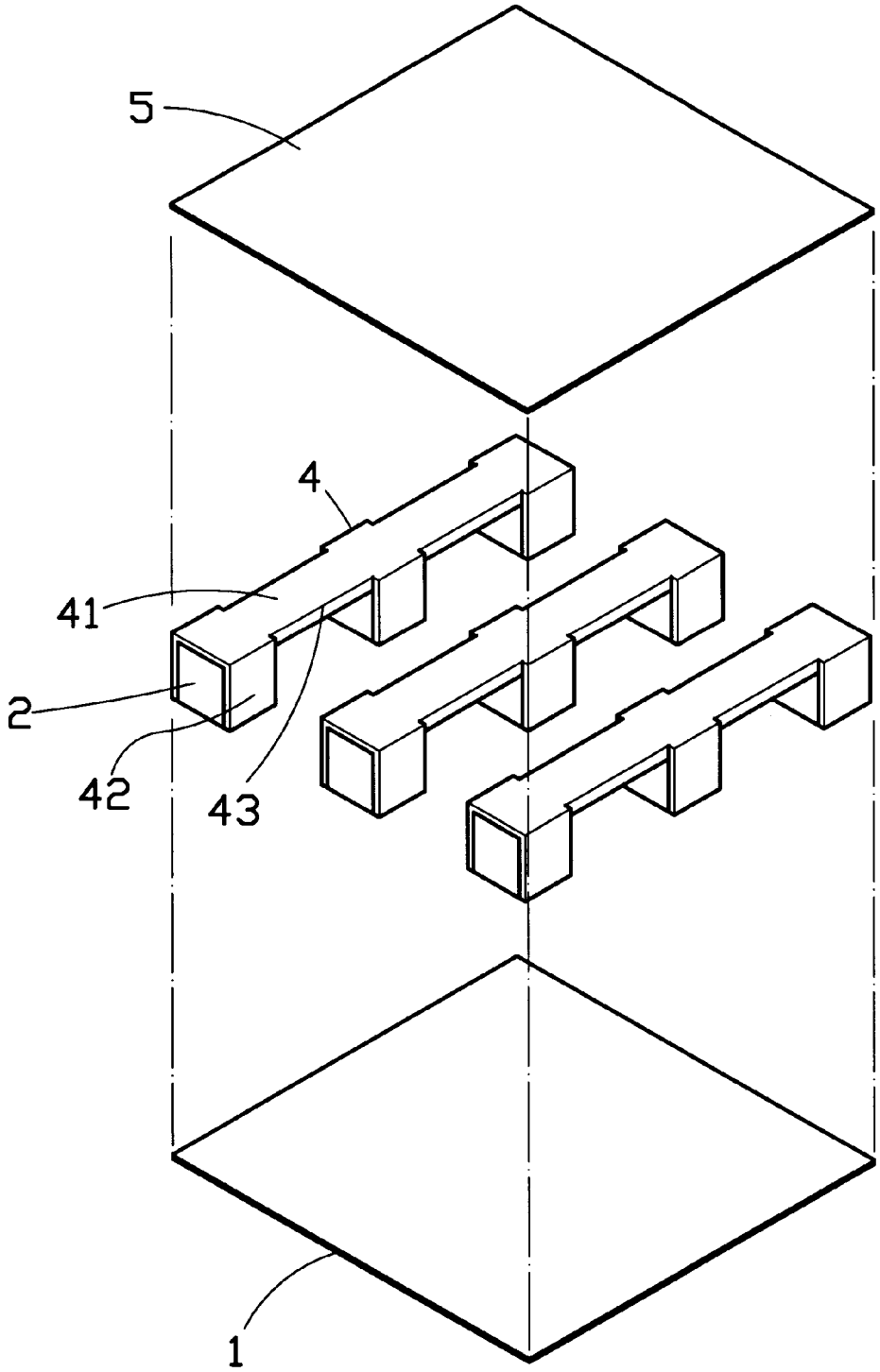
FIG. 11 is an exploded view of a pallet according to a fourth embodiment of the present invention.

FIG. 11 shows still another alternate form of the present invention, in which the aforesaid bottom packing members 3 are eliminated, and only the top packing members 4 are used and packed on the blocks 2.

It is to be understood that the drawings are designed for purposes of illustration only, and are not intended as a definition of the limits and scope of the invention disclosed.

What the invention claimed is:

1. A paper pallet comprising a bottom deckboard made of corrugated paper board, a top deckboard made of corrugated paper board, and a plurality of paper blocks longitudinally and transversely arranged in rows and connected between said bottom deckboard and said top deckboard, wherein a plurality of paper packing members are respectively adhered between said paper blocks and one of said bottom deckboard and said top deckboard, said packing members each having an elongated base adhered between one of said bottom deckboard and said top deck board and one row of the paper blocks and pairs of packing flaps bilaterally extended from two opposite long sides of said elongated base and respectively adhered to the corresponding row of blocks at two opposite sides.

2. The paper pallet of claim 1 wherein said bottom deckboard and said top deckboard are respectively covered with a layer of water proof material.

3. The paper pallet of claim 1 wherein said paper blocks each are comprised of a plurality of rectangular corrugated paper board frames wrapped one within another.

4. The paper pallet of claim 1 wherein said paper blocks each are comprised of pieces of rectangular corrugated paper board arranged in a stack.

5. The paper pallet of claim 1 wherein said paper blocks each are comprised of a rectangular open frame of corrugated paper board and a cardboard tube fitted into said rectangular open frame of corrugated paper board.

6. The paper pallet of claim 1 wherein said packing members each have pairs of reinforcing flaps extended from two long sides of the respective elongated base.

7. The paper pallet of claim 1 wherein said packing members include bottom packing members adhered between said bottom deckboard and said paper blocks and packed on the blocks, and top packing members adhered between said top deckboard and said paper blocks and packed on said paper blocks.

8. The paper pallet of claim 7 wherein said bottom packing members are adhered to said paper blocks in longitudinal direction, and said top packing members are adhered to said paper blocks in transverse direction.

* * * * *